United States Patent [19]
Olah

[11] Patent Number: 4,472,268
[45] Date of Patent: Sep. 18, 1984

[54] UPGRADING OF NATURAL GASOLINE WITH TRIFLUOROMETHANE SULFONIC ACID, HYDROFLUORIC ACID AND LEWIS ACID CATALYST

[75] Inventor: George A. Olah, Beverly Hills, Calif.

[73] Assignee: El Paso Products Company, Odessa, Tex.

[21] Appl. No.: 458,825

[22] Filed: Jan. 18, 1983

[51] Int. Cl.[3] ..... C10G 35/06
[52] U.S. Cl. ..... 208/134; 585/725; 585/740
[58] Field of Search ..... 208/134; 585/724, 725

[56] References Cited

U.S. PATENT DOCUMENTS

| | | | |
|---|---|---|---|
| 3,778,489 | 12/1973 | Parker et al. | 585/724 |
| 3,852,184 | 12/1974 | Siskin et al. | 252/442 |
| 4,025,577 | 5/1977 | Siskin et al. | 585/724 |
| 4,035,286 | 7/1977 | McCaulay et al. | 208/134 |
| 4,064,189 | 12/1977 | Siskin et al. | 585/708 |
| 4,094,924 | 6/1978 | Siskin et al. | 585/724 |
| 4,098,833 | 7/1978 | Wristers | 585/465 X |
| 4,300,008 | 11/1981 | McCaulay | 208/134 |

FOREIGN PATENT DOCUMENTS

| | | | |
|---|---|---|---|
| 1020590 | 11/1977 | Canada | 585/724 |

OTHER PUBLICATIONS

Olah et al., "Superacids", *Science*, Oct. 5, 1979, vol. 206, pp. 13–20.

*Primary Examiner*—Delbert E. Gantz
*Assistant Examiner*—Lance Johnson
*Attorney, Agent, or Firm*—Depaoli & O'Brien

[57] ABSTRACT

Natural gasoline of low octane value derived from natural gas is upgraded to higher octane value by means of a liquid ternary catalyst comprising trifluoromethanesulfonic acid and hydrogen fluoride in conjunction with a Lewis acid of the formula $MX_n$ wherein M is selected from Group III-A, IV-B or V elements of the Periodic Table, x is a halogen and n is a number varying from 3 to 6. Effective upgrading is achieved when the Lewis acid:HF mole ratio of the catalyst ranges from 1:2 to 2:1 at temperatures less than about 120° C. under liquid phase conditions.

9 Claims, No Drawings

UPGRADING OF NATURAL GASOLINE WITH TRIFLUOROMETHANE SULFONIC ACID, HYDROFLUORIC ACID AND LEWIS ACID CATALYST

This application is related to copending applications, Ser. No. 458,826 and Ser. No. 458,827, filed Jan. 18, 1983, "Superacids," George A. Olah et al, *Science*, Reprint Series, Oct. 5, 1979, Volume 206, pp. 13–20, which disclose the upgrading of natural gasoline with related catalysts.

BACKGROUND OF THE INVENTION

1. Field of the Invention

This invention relates to a process for upgrading hydrocarbons of relatively low boiling point and relatively poor antiknock properties into hydrocarbons having higher antiknock ratings and suitable for use as motor fuel blending stocks. More particularly, the invention relates to the use of a catalyst system comprising trifluoromethanesulfonic acid and hydrogen fluoride in conjunction with a Lewis acid for the conversion of natural gasoline derived from natural gas into a gasoline product of higher octane number than the original charge stock.

2. Description of the Prior Art

Saturated highly branched-chain paraffin hydrocarbons, and particularly mixtures thereof, occurring in gasoline fractions are very desirable motor fuel components because of their antiknock properties. It is known, for example, that the more highly branched chain isomers of paraffins are more valuable than the corresponding unbranched or less branched paraffins because of their higher octane rating. The 2,2-dimethylbutane isomer of hexane, for example, has an octane number of 92 whereas normal hexane has an octane rating of 25. Similarly, 2,2,3-trimethylbutane (triptane) also has a highly branched chain structure and provides fuel characteristics far exceeding the isoheptanes such as methylhexanes and dimethylpentanes. Because of its highly branched structure, the octane rating of triptane exceeds that of isooctane which has a rating of 100. The demand for motor fuels of high octane value without lead additives has increased steadily and a variety of hydrocarbon processes have been suggested whereby various hydrocarbon oils, such as straight run gasolines, naphthas and similar hydrocarbon mixtures, have been upgraded to produce gasoline of higher octane value.

U.S. Pat. No. 3,142,633 relates to conversion of naphthas to hydrocarbons boiling in the middle distillate range by treatment with anhydrous liquid HF, either alone or augmented with up to 60 mol percent of $BF_3$.

U.S. Pat. No. 3,594,445 discloses the isomerization of normal and naphthenic paraffins by employing a catalyst containing (1) a fluoride of a metal of Group V such as antimony pentafluoride and (2) a fluorosulfonic acid in the presence of hydrogen and an olefin and/or an alkyl fluorosulfonate.

U.S. Pat. No. 3,766,286 discloses the isomerization of paraffinic and/or alkyl substituted aromatic hydrocarbons with a catalyst comprising (a) a Lewis acid of the formula $MX_n$ where M is selected from Group IV-B, V or VI-B of the Periodic Table, X is a halogen and n varies from 3 to 6, and (b) a strong Bronsted acid comprising fluorosulfuric acid. trifluoromethanesulfonic acid, trifluoroacetic acid or mixtures thereof.

U.S. Pat. No. 3,839,489 discloses the isomerization of paraffinic feedstocks using a catalyst consisting of arsenic pentafluoride, antimony pentafluoride, and mixtures thereof with either trifluoromethanesulfonic acid or hydrogen in the presence of hydrogen.

U.S. Pat. No. 3,996,116 discloses the conversion of straight-chain saturated hydrocarbons into branched-chain saturated hydrocarbons by oxidizing the hydrocarbons in liquid phase in the presence of a superacid such as $HFSO_3$ by electrolysis at a voltage between the half wave voltage of the hydrocarbon and that of the superacid.

U.S. Pat. No. 4,044,069 discloses a process for the isomerization and alkylation of paraffinic hydrocarbons by means of a catalyst composition comprising a mixture of Lewis acids such as arsenic pentafluoride and a sulphonic acid corresponding to the general formula RF $(SO_3H)p$ where RF represents an alkylperfluorinated or cycloalkylperfluorinated hydrocarbon radical having a number of carbon atoms between 2 and 8 and p is 1 or 2.

Other pertinent literature art includes the articles entitled "Lower Paraffin Hydrocarbons—Catalytic Conversion by $BF_3$ With HF" by E. C. Hughes and S. M. Darling (Std. Oil Co. 1951) *Ind. & Eng. Chemistry*, Vol. 43, No. 3, p. 746, and "Mechanism of Acid-Catalyzed Isomerization of the Hexanes" by D. A. McCaulay (Std. Oil Co. 1959) *J. Am. Chem. Soc.*, Vol. 81, p. 6437.

None of the prior art described above discloses a catalyst composition of the type hereinafter described or the use of the same for the direct conversion of natural gasoline in accordance with the invention. Although a number of patents have been granted on processes involving Lewis acid and/or Bronsted catalysis, such processes have generally been based on the isomerization of relatively pure hydrocarbons such as butane, pentane, hexane or heptane and are primarily adapted for such isomerizations. In the patent literature, it is also generally stated that processes for the isomerization of pure hydrocarbons are also applicable to various distillates, including kerosene, natural gasoline, straight run gasoline, and the like. While such processes undoubtedly can be applied to certain distillate fractions, they do not serve as a useful prototype for the catalytic upgrading of distillates of the nature of gasoline due to the fact that octane numbers are only slightly improved and, in many cases, the octane improvement is substantially nil. See, for example, U.S. Pat. No. 2,373,674.

SUMMARY OF THE INVENTION

The present invention relates to the upgrading of natural gasoline by treatment with a liquid ternary catalyst system comprising trifluoromethanesulfonic acid and hydrogen fluoride in conjunction with a Lewis acid of the formula $MX_n$ where M is selected from Group III-A, IV-B, or V elements of the Periodic Table, X is a halogen and n is a number varying from 3–6. More specifically, natural gasoline of low octane value (RON 67–69) derived from natural gas is upgraded to a higher octane value (RON 87–92) by treatment with a catalyst of the character described at temperatures less than 120° C. for short contact times under a pressure sufficient to ensure a Lewis acid-HF mole ratio within the range of 1:2 to 2:1. By means of the invention, a relatively simple and practical upgrading treatment is provided whereby lead-free gasoline can be obtained directly from hydrocarbon materials having relatively poor antiknock properties without the necessity of increasing the octane value by adding lead or manganese additives or by addition of higher-octane aromatics or olefins, all which may pose environmental or health hazard problems. Furthermore, the process of the invention may be applied to charge stocks which contain aromatic hydrocarbons and thus may be carried out in a single stage operation without a costly preliminary separation step such as dearomatization. By adding a small amount of $C_2$–$C_{10}$ olefins, preferably butylenes, to the natural gasoline charge stock, an equilibrium concentration is maintained whereby catalyst consumption is minimized and the upgrading reaction may be rapidly carried out at modest temperatures.

DETAILED DESCRIPTION OF THE INVENTION

The starting material employed in the process of the invention is natural gasoline derived from natural gas, a naturally occurring mixture of hydrocarbon and non-hydrocarbon gases found in geological formations often in association with petroleum. Separation of components higher in molecular weight than methane by processes such as compression, cooling or absorption yields what is referred to as natural gas liquids. Removal of ethane, propane and most of the butanes yields natural gasoline, a complex hydrocarbon mixture predominantly paraffinic in character, mainly pentanes, hexanes and heptanes, with a carbon number of 4 to 10. The natural gasoline employed in the process generally contains less than 15 weight percent cyclic paraffins, 5 weight percent aromatics and no detectable amount of olefins. The gasoline has a boiling range at atmospheric pressure of about 26.6° C. to 114.4° C. (80° F. to 238° F.). A typical analysis of a natural gasoline from the Odessa, Tex., region has a research octane number of about 65–70 and a composition as shown in Table I.

TABLE I

| Component | Wt. % |
|---|---|
| propane | .4 |
| isobutane | .2 |
| n-butane | 1.3 |
| 2,2-dimethylpropane | .1 |
| isopentane | 28.1 |
| n-pentane | 23.7 |
| 2,2-di-me-butane | .2 |
| 2,3-di-me-butane/cp | 2.6 |
| 2-methylpentane | 6.1 |
| 3-methylpentane | 4.2 |
| n-hexane | 6.6 |
| 2,2-di-me-pentane | .1 |
| methylcyclopentane | 3.9 |
| 2,4-di-me-pentane | .1 |
| 3,3-di-me-pentane | .1 |
| benzene | 1.6 |
| 2,2,3-tri-me-butane | .1 |
| cyclohexane | 2.7 |
| 2-methylhexane | .9 |
| 2,3-di-me-pentane | .6 |
| 1,1-di-me-cy-pent | .3 |
| 3-methylhexane | 1.3 |
| 1,t-3-di-me-cy-pent | .7 |
| 2,2,4-tri-me-pent | .7 |
| 1,t-2-di-me-cy-pent | 1.2 |
| n-heptane | 2.1 |
| methylcyclohexane | 2.1 |
| 1,c-2-di-me-cy-pent | .2 |
| ethylcyclopentane | .3 |
| 2,5-dimethylhexane | .1 |
| 2,4-dimethylhexane | .1 |
| 1,t-2,c-4-trime-cp | .2 |
| 1,t-2,c-3-trime-cp | .3 |
| toluene | 1.2 |

TABLE I-continued

| Component | Wt. % |
|---|---|
| 2,3-dimethylhexane | .1 |
| 2-methylheptane | .5 |
| 4-methylheptane | .1 |
| 3,4-dimethylheptane | .0 |
| 3-methylheptane | .2 |
| 1,c-3-di-me-cy-hex | .3 |
| 1,t-4-di-me-cy-hex | .1 |
| 1,t-2-di-me-cy-hex | .1 |
| n-octane | .6 |
| 1-me-c-2-et-cp | .0 |
| ethyl-cyclohexane | .3 |
| ethyl benzene | .3 |
| m-p xylene | .2 |
| o-xylene | .1 |
| n-nonane | .2 |
| n-decane | .1 |
| Total | 97.6 |
| Total unidentified | 2.4 |
| Total aromatics | 3.4 |
| Total cyclics | 12.7 |

The catalyst employed in the invention is a liquid catalyst mixture comprising trifluoromethanesulfonic acid and hydrogen fluoride in conjunction with a Lewis acid of the formula $MX_n$ wherein M is selected from Group III-A, IV-B, or V elements of the Periodic Table, x is a halogen and n is a number varying from 3 to 6. Specific examples of useful Lewis acids include boron trifluoride, antimony pentafluoride, arsenic pentafluoride, tantalum pentafluoride, niobium pentafluoride, vanadium pentafluoride, titanium tetrafluoride, bismuth pentafluoride, phosphorus pentafluoride, zirconium tetrafluoride, mixtures thereof and the like. Moreover, chlorine, bromine or iodine may be substituted for fluorine without affacting the efficiency of the catalyst system. The Periodic Table referred to is that described in "The Encyclopedia of Chemistry," Reinhold Publishing Corporation, 2nd ed. (1966) at page 790. The term "elements" as used herein refers to the metals and metalloids of the aforementioned groups of the Periodic Table.

While it is well known that Lewis acids such as $BF_3$ have been used in conjunction with hydrogen fluoride as isomerization catalysts, it has been recognized in U.S. Pat. No. 2,451,018 and U.S. Pat. No. 2,513,103, among others, that when boron trifluoride is used with hydrogen fluoride the amount should under no circumstances exceed 50 mol percent of the fluorides, and preferably not exceed 15 mol percent. In contradistinction thereto, the amount of Lewis acid used in the present invention is in large excess of the amount of the hydrogen fluoride. It has been determined that a Lewis acid to HF mole ratio within the range of 1:2 to 2:1, is essential in effecting the direct upgrading of natural gasoline. When using a Group III-A Lewis acid halide such as $BF_3$ within this range, the excess is equivalent to an excess ranging from about 170% to 680% by weight based on the weight of the HF, or about 62% to 87% by weight based on the weight of the mixed catalyst. The catalyst of the present invention is thus distinguished from catalysts heretofore proposed in which the quantity of Lewis acid is either less than the weight of HF, or is present in an amount such that the total amount does not exceed 50 mol percent of the fluorides.

In the preferred embodiment of the invention, effective upgrading is achieved when the Lewis acid:HF mole ratio is 1:1 at temperatures ranging from 10° C. to 120° C., preferably about 25° C. to 100° C., under a pressure sufficient to maintain the hydrocarbon and HF in liquid phase and to keep the desired quantity of Lewis acid in the reaction zone. Expressed in terms of partial pressure, the amount of Lewis acid sufficient to ensure a Lewis acid-HF mole ratio within the broader range of 1:2 to 2:1 will vary, in accordance with the invention, generally from 200 to about 1200 pounds per square inch. The partial pressure within the range mentioned should not exceed the Lewis acid upper limit of 2:1.

The Bronsted acid components of the catalyst mixture consist of trifluoromethanesulfonic acid and hydrogen fluoride wherein the hydrogen fluoride is present in an amount ranging from 10 to 30 percent by weight, preferably 15 to 25% by weight, based on the trifluoromethanesulfonic acid. The molar ratio of Bronsted acid to Lewis acid ranges from about 20:1 to 1:5 and is preferably about 5:1 to 1:1. Other sulfonic acids such as fluorosulfonic acid ($FSO_3H$) have been found unsuitable since they are readily deactivated by the presence of aromatics in the natural gasoline charge stock.

The catalyst to hydrocarbon ratio maintained in the reaction zone ranges from 0.1:1 to 2:1 by liquid volume and is usually about 1:1 by liquid volume. The upgrading reaction is carried out by contacting the natural gasoline charge stock with the catalyst under liquid phase conditions for a period of time ranging from about 10 minutes to 4 hours, and preferably about 30 minutes to 2 hours.

The addition of small amounts of $C_2$–$C_{10}$ olefins, preferably butylenes, to the natural gasoline charge stock to be upgraded is desirable and leads to the formation of alkyl flourides or fluorosulfates whereby an equilibrium concentration of cations is maintained in the system during the upgrading reaction. In the absence of olefins, decreased catalyst activity is observed since the acid catalyst itself serves to form the necessary cation by protolysis-oxidation and is thus slowly consumed. This problem can be minimized by utilizing a feed material which itself contains a small amount of $C_2$–$C_{10}$ monoolefins or by adding an olefin, such as butylene, in amounts ranging from 0.05 to 10.0 weight percent, preferably 1 to 5 weight percent, based on the hydrocarbon feed. Cyclic olefins, such as dicyclopentadiene, may also be used.

The process of the invention can be carried out either in a continuous or batchwise manner, or combinations of continuous and batchwise treatment may be employed. In the conversion zone, any suitable reactor apparatus which provides thorough contact between the catalyst and the various components of the natural gasoline feed material, including recycled material, may be used. Since it is particularly important to achieve thorough contact between the catalyst and hydrocarbon mixture, it is contemplated that batch or continuous reactors of the agitator type, the circulator-mixer type, the tower type, or tube reactors with suitable baffles will be used whereby the catalyst is quickly and intimately dispersed throughout the hydrocarbon mixture. The reactor and other apparatus which is in contact with the catalyst should be substantially inert, such as Monel, teflon, aluminum alloys, Hastelloy, etc., so that the catalyst does not react therewith to form substances that either inhibit the upgrading reaction or form excessive amounts of contaminants. This is particularly important in sensitive areas, such as valves, which are exposed to the catalyst.

As noted above, it has been found desirable to maintain the upgrading reaction in the liquid phase at modest temperatures and to efficiently mix the reaction mixture to achieve thorough contact between the catalyst and hydrocarbon materials. During the upgrading process, the hydrocarbons undergo a combination of reactions including isomerization, cracking, disproportionation and alkylation. Experiments have shown, for example, that significant isomerization of straight chain paraffins to branched chain paraffins occurs. Also, lower molecular weight hydrocarbons possibly form molecules of an average or intermediate molecular weight with higher molecular weight hydrocarbons which may be isomerized or otherwise reacted. An increase in the $C_6$–$C_8$ fraction also is effected due to alkylation. In any event, it is apparent that paraffins are converted into increasing proportions of isocompounds and that some of these compounds are unsaturated, naphthenic and aromatic hydrocarbons.

The upgrading process may, if desired, be carried out in the presence of hydrogen which helps suppress side reactions, such as cracking and disproportionation, and minimize the amount of hydrocarbon products entering the lower acid or catalyst phase of the reaction mixture. Hydrogen may be introduced into the reaction in an amount sufficient to provide a partial pressure of hydrogen of 100 to 1000 pounds per square inch, preferably 100 to 300 psi. These relatively modest hydrogen pressures substantially suppress side reactions in the upgrading process, particularly cracking. The gasoline range hydrocarbons are rich in isoalkanes (isobutanes, isopentanes, isohexanes, isoheptanes, isooctanes) and contain relatively small amounts of straight chain (or normal) butane, pentane and hexane. Propane and butanes can be "topped off" in a fractionating column for separate use and to decrease volatility of the upgraded gasoline. The desired product mixture boiling from 28.8° C. to 125.5° C. (84° F. to 258° F.) is withdrawn for use or may be further fractionated and a portion returned to the reaction zone. The catalyst phase is separated from the hydrocarbons first by depressurizing boron trifluoride and then removing hydrogen fluoride either as a gaseous product or a liquid phase. The catalyst may be directly recycled and reused or purified to remove certain hydrocarbons, notably unsaturates and aromatics, which tend to accumulate in the catalyst phase in the form of a complex during the upgrading reaction. The accumulation of too much hydrocarbon in the catalyst phase exerts a poisoning effect which can be remedied by either distillation, by treatment with a solvent or by treatment with a material which is immiscible with the hydrocarbons and forms a complex with the fluorides.

The following examples illustrate the best mode now contemplated for carrying out the invention without, however, limiting its scope.

EXAMPLES

Example 1

A 200 ml stainless steel pressure autoclave, fitted with a stirrer, suitable inlet and outlet connections, thermocouple to measure temperature, pressure gage and electric heating mantle, was charged with 20 ml of hydrogen fluoride, 80 ml of trifluoromethanesulfonic acid, 100 ml of natural-gas liquid from the Odessa (Texas) region and 5% (w/w) mixture of cis- and trans-2-butenes. After closing the autoclave it was pressurized at 25° C. with ~800 psi boron trifluoride and stirred for 120 minutes. After depressurization the hydrocarbon liquid was separated, washed acid-free, dried and analyzed by gas liquid-chromotography and mass spectrometry. The estimate research octane number (RON) of the starting natural-gas liquid is 66–68, that of the upgraded gasoline 86–88.

Example 2

Treatment was carried out as in Example (1) but in the presence of 100 p.s.i. hydrogen. Upgraded gasoline has a research octane number of 88–89.

Example 3

Treatment was carried out as in Example (2) but adding 5% (w/w) dicyclopentadiene instead of butenes to the natural gas feed and carrying out reaction in the presence of 200 p.s.i. hydrogen. Upgraded gasoline has a research octane number of 89–90.

Example 4

Treatment was carried out as in Example (1) but at 55° C. for 60 minutes. Research octane number of product is 85–86.

Example 5

Treatment was carried out as in Example (2) but at 95° C. for 20 minutes. Research octane number of product is 89–90.

Example 6

Treatment was carried out as in Example (2) but with phosphorus pentafluoride instead of boron trifluoride. Research octane number of product is 83–86.

Example 7

Treatment was carried out as in Example (2) but with arsenic pentafluoride. Research octane number is 84–85.

Example 8

Treatment was carried out as in Example (2) but with only 200 p.s.i. of boron trifluoride. The reaction was stirred at 50° C. for 240 minutes. The research octane number of upgraded product is 89–90.

What is claimed is:

1. A process of upgrading low octane natural gasoline derived from natural gas, said gasoline having a boiling range of about 26.6° C. to 114.4° C. and being predominantly paraffinic in character and containing less than 15 wt.% cyclic paraffins and 5 wt.% aromatics, which comprises contacting said gasoline under reaction conditions comprising a temperature less than about 120° C. and contact time less than about 4 hours with a liquid catalyst composition comprising trifluoromethane sulfonic acid and 15 to 25 wt.% hydrogen fluoride, based on the sulfonic acid, in conjunction with a Lewis acid of the formula $MX_n$ wherein M is selected from Group III-A, IV-B or V elements of the Periodic Table, x is a halogen and n is a number varying from 3 to 6 wherein the amount of Lewis acid is sufficient to ensure a Lewis acid:HF mole ratio of 1:2 to 2:1, and thereafter recovering an upgraded natural gasoline product of higher octane value having a boiling range of about 28.8° C. to 125.5° C.

2. The process of claim 1 wherein the mole ratio of hydrogen fluoride to Lewis acid is about 1:1.

3. The process of claim 1 wherein the upgrading reaction is carried out in the presence of hydrogen.

4. The process of claim 1 wherein the hydrogen fluoride is present in amounts of 10 to 30% by weight based on the trifluoromethanesulfonic acid.

5. The process of claim 1 wherein a $C_2$–$C_{10}$ olefin is added to the natural gasoline charge stock in amounts ranging from about 0.05 to 10 percent by weight based on the charge stock.

6. The process of claim 5 wherein butylene is added to the feedstock in an amount ranging from about 1 to 5 percent by weight.

7. The process of one of claims 1 to 6 wherein the Lewis acid is boron trifluoride.

8. The process of one of claims 1 to 6 wherein the Lewis acid is phosphorus pentafluoride.

9. The process of one of claims 1 to 6 wherein the Lewis acid is arsenic pentafluoride.

* * * * *